US009130356B2

(12) United States Patent
Kowalski et al.

(10) Patent No.: US 9,130,356 B2
(45) Date of Patent: Sep. 8, 2015

(54) SPARK PLUG HAVING A THIN NOBLE METAL FIRING PAD

(71) Applicant: FEDERAL-MOGUL IGNITION COMPANY, Southfield, MI (US)

(72) Inventors: Kevin J. Kowalski, Perrysburg, OH (US); Frederick J. Quitmeyer, Rochester Hills, MI (US); Nathan A. Thomson, Southgate, MI (US); Curtis W. Verhoff, Canton, MI (US); Richard L. Keller, Whitehouse, OH (US)

(73) Assignee: Federal-Mogul Ignition Company, Southfield, MI (US)

( * ) Notice: Subject to any disclaimer, the term of this patent is extended or adjusted under 35 U.S.C. 154(b) by 241 days.

(21) Appl. No.: 13/908,255

(22) Filed: Jun. 3, 2013

(65) Prior Publication Data

US 2013/0320835 A1 Dec. 5, 2013

Related U.S. Application Data

(60) Provisional application No. 61/654,558, filed on Jun. 1, 2012, provisional application No. 61/656,167, filed on Jun. 6, 2012, provisional application No. 61/681,289, filed on Aug. 9, 2012, provisional application No. 61/716,250, filed on Oct. 19, 2012, provisional application No. 61/759,088, filed on Jan. 31, 2013.

(51) Int. Cl.
*H01T 13/39* (2006.01)

(52) U.S. Cl.
CPC ..... *H01T 13/39* (2013.01)

(58) Field of Classification Search
None
See application file for complete search history.

(56) References Cited

U.S. PATENT DOCUMENTS

| | | | | |
|---|---|---|---|---|
| 5,502,351 | A * | 3/1996 | Katoh et al. | 313/141 |
| 5,797,383 | A | 8/1998 | Matsubara et al. | |
| 5,990,602 | A | 11/1999 | Katoh et al. | |
| 6,337,533 | B1 | 1/2002 | Hanashi et al. | |
| 6,346,766 | B1 * | 2/2002 | Kanao et al. | 313/141 |
| 6,523,515 | B2 | 2/2003 | Kanao | |
| 6,642,638 | B2 | 11/2003 | Ishiguro | |
| 6,676,468 | B2 | 1/2004 | Ishiguro et al. | |
| 6,707,237 | B2 | 3/2004 | Teramura et al. | |
| 6,853,116 | B2 | 2/2005 | Hori et al. | |
| 6,864,623 | B2 | 3/2005 | Ishikawa | |
| 6,923,699 | B2 | 8/2005 | Matsubara et al. | |
| 7,385,339 | B2 * | 6/2008 | Lineton et al. | 313/141 |
| 7,557,495 | B2 | 7/2009 | Tinwell | |
| 7,569,978 | B2 * | 8/2009 | Tinwell | 313/141 |
| 7,615,915 | B2 | 11/2009 | Ito et al. | |
| 7,804,232 | B2 | 9/2010 | Kumagai et al. | |
| 7,851,984 | B2 * | 12/2010 | Zdeblick et al. | 313/141 |
| 7,973,459 | B2 | 7/2011 | Tinwell | |
| 8,106,572 | B2 | 1/2012 | Tanaka et al. | |
| 8,106,573 | B2 | 1/2012 | Boehler et al. | |
| 8,115,372 | B2 | 2/2012 | Kameda | |
| 8,203,258 | B2 | 6/2012 | Kameda et al. | |
| 8,212,462 | B2 | 7/2012 | Kato | |
| 8,212,463 | B2 | 7/2012 | Sakayanagi et al. | |

(Continued)

*Primary Examiner* — Britt D Hanley
(74) *Attorney, Agent, or Firm* — Reising Ethington P.C.

(57) ABSTRACT

A spark plug includes a metallic shell, an insulator, a center electrode, a ground electrode, and a thin firing pad. The thin firing pad is made from a noble metal and can be attached to the center electrode, the ground electrode, or to both. In some examples, the thin firing pad possesses certain geometric properties and relationships that can improve ignitability and durability of the thin firing pad.

26 Claims, 3 Drawing Sheets

(56) References Cited

U.S. PATENT DOCUMENTS

| | | | | |
|---|---|---|---|---|
| 2004/0092193 | A1* | 5/2004 | Musasa et al. | 445/7 |
| 2009/0140624 | A1* | 6/2009 | Kameda et al. | 313/141 |
| 2010/0084391 | A1 | 4/2010 | Nakayama et al. | |
| 2010/0109502 | A1 | 5/2010 | Nakayama et al. | |
| 2011/0133625 | A1 | 6/2011 | Sakayanagi | |
| 2011/0198981 | A1 | 8/2011 | Kishimoto et al. | |
| 2012/0025690 | A1 | 2/2012 | Kohl | |
| 2012/0025691 | A1 | 2/2012 | Sakayanagi et al. | |
| 2012/0086326 | A1 | 4/2012 | Niessner et al. | |
| 2014/0042892 | A1* | 2/2014 | Kowalski et al. | 313/141 |
| 2014/0111078 | A1* | 4/2014 | Kowalski et al. | 313/141 |
| 2014/0210334 | A1* | 7/2014 | Kowalski et al. | 313/141 |

* cited by examiner

SPARK PLUG HAVING A THIN NOBLE METAL FIRING PAD

REFERENCE TO RELATED APPLICATIONS

This application claims the benefit of U.S. Provisional Ser. Nos. 61/654,558 filed on Jun. 1, 2012, 61/656,167 filed on Jun. 6, 2012, 61/681,289 filed on Aug. 9, 2012, 61/716,250 filed on Oct. 19, 2012, and 61/759,088 filed on Jan. 31, 2013, the entire contents of which are incorporated herein.

TECHNICAL FIELD

This invention generally relates to spark plugs and other ignition devices for internal combustion engines and, in particular, to a flat firing pad that may be attached to a center electrode, a ground electrode, or both.

BACKGROUND

Spark plugs can be used to initiate combustion in internal combustion engines. Spark plugs typically ignite a gas, such as an air/fuel mixture, in an engine cylinder or combustion chamber by producing a spark across a spark gap defined between two or more electrodes. Ignition of the gas by the spark causes a combustion reaction in the engine cylinder that is responsible for the power stroke of the engine. The high temperatures, high electrical voltages, rapid repetition of combustion reactions, and the presence of corrosive materials in the combustion gases can create a harsh environment in which the spark plug functions. This harsh environment can contribute to erosion and corrosion of the electrodes that can negatively affect the performance of the spark plug over time, potentially leading to a misfire or some other undesirable condition.

To reduce erosion and corrosion of the spark plug electrodes, various types of noble metals and their alloys—such as those made from platinum and iridium—have been used. These materials, however, can be costly. Thus, spark plug manufacturers sometimes attempt to minimize the amount of precious metals used with an electrode by using such materials only at a firing tip or spark portion of the electrodes where a spark jumps across a spark gap.

SUMMARY

According to one embodiment, a spark plug may include a metallic shell, an insulator, a center electrode, a ground electrode, and a thin firing pad. The metallic shell has an axial bore. The insulator has an axial bore and is disposed partially or more within the axial bore of the metallic shell. The center electrode is disposed partially or more within the axial bore of the insulator, and the ground electrode is attached to the metallic shell. The thin firing pad can be attached to the center electrode, the ground electrode, or to both. The thin firing pad is made from a noble metal and includes an unfused sparking surface area that is several times or more larger than an unfused volume.

According to another embodiment, a spark plug may include a metallic shell, an insulator, a center electrode, a ground electrode, and an ultra thin firing pad. The metallic shell has an axial bore. The insulator has an axial bore and is disposed partially or more within the axial bore of the metallic shell. The center electrode is disposed partially or more within the axial bore of the insulator, and the ground electrode is attached to the metallic shell. The ultra thin firing pad can be attached to the center electrode, the ground electrode, or to both. The ultra thin firing pad is made from a noble metal and is attached with a fused portion that extends from a sparking surface all the way through the ultra thin firing pad. The fused portion is located mostly inboard of a peripheral edge of the sparking surface and follows the peripheral edge for a portion or more of the peripheral edge.

According to yet another embodiment, a spark plug firing pad i) is made from a noble metal material; ii) has a greatest dimension across a sparking surface that is several times or more larger than a greatest thickness dimension taken generally orthogonal to the sparking surface, where the greatest thickness dimension is less than or equal to approximately 0.275 mm; and iii) has a sparking surface area that ranges between approximately 0.56 $mm^2$ and 3.5 $mm^2$.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

The firing pads described herein can be used in spark plugs and other ignition devices including industrial plugs, aviation igniters, or any other device that is used to ignite an air/fuel mixture in an engine. This includes spark plugs used in automotive internal combustion engines, and particularly in engines equipped to provide gasoline direct injection (GDI), engines operating under lean burning strategies, engines operating under fuel efficient strategies, engines operating under reduced emission strategies, or a combination of these. The different firing pad embodiments detailed in this description possess certain geometric properties and relationships that provide an efficient, effective, and economical use of noble metal material compared to some known firing tips. For example, and as described below in more detail, the thin firing pads have a relatively large sparking surface area that improves ignitability and durability, yet still limits noble metal material costs. As used herein, the terms axial, radial, and circumferential describe directions with respect to the generally cylindrical shape of the spark plug of FIG. 1 and generally refer to a center axis A, unless otherwise specified.

Figure 1:
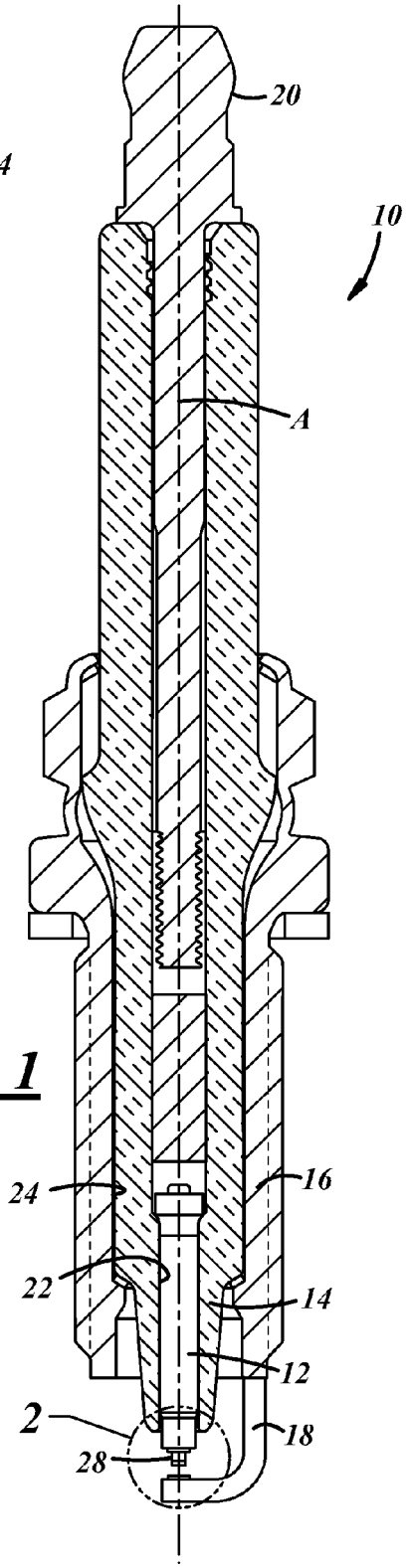
FIG. 1 is a cross-sectional view of an exemplary spark plug.

Referring to FIG. 1, a spark plug 10 includes a center electrode (CE) base or body 12, an insulator 14, a metallic shell 16, and a ground electrode (GE) base or body 18. Other components can include a terminal stud 20, an internal resistor, various gaskets, and internal seals, all of which are known to those skilled in the art. The CE body 12 is generally disposed within an axial bore 22 of the insulator 14, and has an end portion exposed outside of the insulator at a firing end of the spark plug 10. In one example, the CE body 12 is made of a nickel (Ni) alloy material that serves as an external portion of the body, and is made of a copper (Cu) or Cu alloy material that serves as an internal core of the body; other materials and configurations are possible including a body of a single material. The insulator 14 is generally disposed within an axial bore 24 of the metallic shell 16, and has an end nose portion exposed outside of the shell at the firing end of the spark plug 10. The insulator 14 is made of a material, such as a ceramic material, that electrically insulates the CE body 12 from the metallic shell 16. The metallic shell 16 provides an outer structure of the spark plug 10, and has threads for installation in the associated engine.

Figure 2:
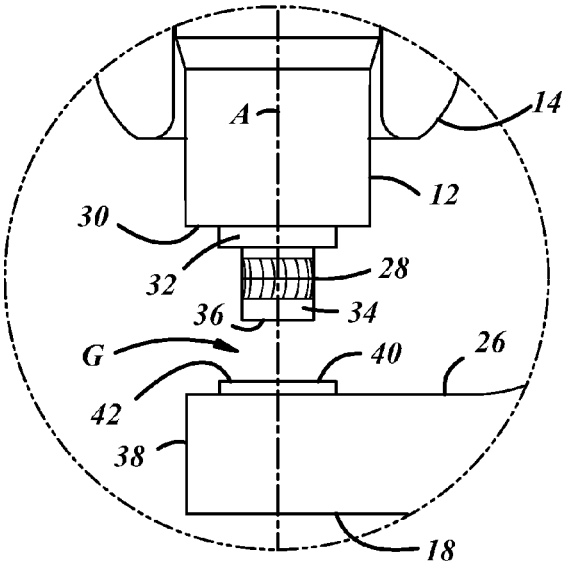
FIG. 2 is an enlarged view of a firing end of the spark plug of FIG. 1, where the firing end includes an exemplary flat firing pad.

Referring now to FIGS. 1 and 2, the GE body 18 is attached to a free end of the metallic shell 16 and, as a finished product, may have a generally and somewhat conventional L-shape. At an end portion nearest a spark gap G, the GE body 18 is axially spaced from the CE body 12 and from a CE firing tip 28 (if a tip is provided). In one example, the GE body 18 is made of a Ni alloy material that serves as an outer cladding layer of the body, and a Cu or Cu alloy material that serves as an internal core of the body; other examples are possible including a non-cored GE body of a single material. Some non-limiting examples of Ni alloy materials that may be used with the CE body 12, GE body 18, or both, include Ni—Cr alloys such as Inconel® 600 or 601. In cross-sectional profile, the GE body 18 can have a generally rectangular shape or some other suitable configuration. The GE body 18 has an axially-facing working surface 26 that generally confronts and opposes the CE body 12 or the CE firing tip 28 across the spark gap G. The working surface 26 can be generally planar and without a recess, or it could have a recess or other surface feature to accommodate seating of the firing portion, to cite several possibilities.

In the embodiment shown in the figures, the spark plug 10 includes a CE firing tip 28 that is attached to an axially-facing working surface 30 of the CE body 12 for discharging a spark across the spark gap G. Referring to FIG. 2, the CE firing tip 28 shown here has a two-piece and generally rivet-like construction and includes a first piece 32 welded to a second piece 34. The first piece 32 is attached to the CE body 12, and the second piece 34 is attached to the first piece. The second piece 34 has an axially-facing sparking surface 36 from which sparking occurs when the spark is discharged across the spark gap G. The first piece 32 can be made of a Ni-alloy material, and the second piece 34 can be made of a noble metal material such as an iridium (Ir), platinum (Pt), or ruthenium (Ru) alloy; other materials for these pieces are certainly possible. In other embodiments not shown in the drawings, for example, a separate CE firing tip is absent in which case sparking occurs from the CE body itself, the CE firing tip could have a one-piece and single-material construction, or the CE firing tip could have different shapes including cylinders, bars, columns, wires, balls, mounds, cones, flat pads, rings, or sleeves. The present spark plug is not limited to any particular firing end arrangement, as the firing pads described herein could be used with any number of firing end arrangements, including those with or without separate CE firing tips.

Figure 4:
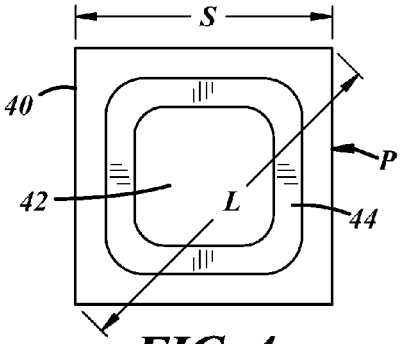
FIG. 4 is another enlarged view of the firing pad of FIG. 3B, shown isolated for demonstrative purposes.
Figure 5:
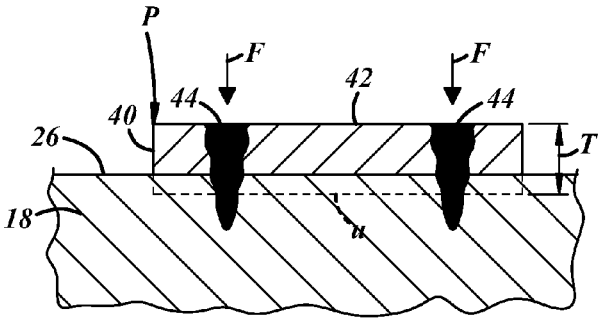
FIG. 5 is a cross-sectional view of the firing pad taken at the arrows 5-5 in FIG. 3B.

Referring to FIGS. 1 and 2, the spark plug 10 includes a flat firing pad or portion 40 attached to the working surface 26 of the GE body 18 for discharging a spark across the spark gap G. Though shown attached directly to the GE body 18, in other embodiments the firing pad 40 could be attached to an intermediate piece which itself could be attached directly to the GE body, similar to the CE firing tip 28 shown in the figures and described above. The exemplary firing pad 40 is "ultra thin" which means that its greatest sparking surface dimension is at least several times larger (e.g., four or five times larger) than its greatest thickness dimension. For example, for the thin firing pad 40 shown in FIGS. 4 and 5, the greatest dimension across the sparking surface is length L taken at a diagonal of the square shape. This dimension is at least several times larger than the greatest thickness dimension T, which is shown in FIG. 5 extending between surfaces at a peripheral edge P. This relationship is not true for many known firing tips with a so-called fine wire construction in which a diameter taken at a sparking surface of the wire is less than an axial height of the wire. In FIGS. 2 and 5, the thickness T is measured in the axial direction, but the thickness T could be measured in other directions depending on the firing pad's configuration and orientation at the firing end. For example, if the firing pad were attached to a terminal or distal end surface, such as surface 38, and were aligned to radially face a side surface of the CE body or CE tip, then the thickness dimension T would be measured in the radial direction.

As previously mentioned, the thin firing pad 40 possesses certain geometric properties and satisfies certain relationships that provide an efficient, effective, and economical use of noble metal material and, ultimately improves the overall performance of the spark plug 10. The firing pad 40 has a relatively large surface area at a sparking surface 42 when compared to known fine-wire spark plugs, for example. The large sparking surface area improves ignitability and durability of the firing pad 40 during operation, and can limit material degradation at the sparking surface 42. For example, the large surface area may inhibit or altogether eliminate growth in the spark gap G over the lifetime of use of the spark plug 10. Without wishing to exclude other theories of causation, it is currently believed that these improvements are due in part to the greater area exposed and available for discharging and exchanging a spark across the spark gap G. The following surface areas and volumes are directed to the non-fused portions of the firing pad 40 that are not melted or fused during a laser welding process or the like. In the example of FIGS. 4 and 5, this would correspond to the total surface area and total volume of firing pad 40 minus the area and volume, respectively, of fused portions 44. Fused portions or weldments typically possess different characteristics than the noble metal alloy of the firing pad 40 and may in some cases influence the sparking performance of the spark plug 10.

Figure 3B:
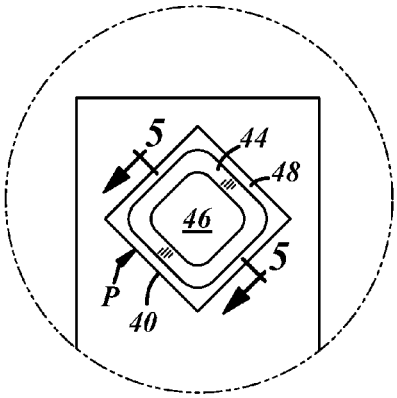
FIG. 3B is an enlarged view of an exemplary flat firing pad attached to the ground electrode of FIG. 3A.
Figure 3A:
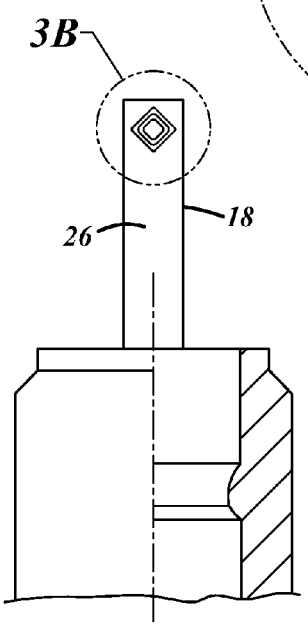
FIG. 3A is an enlarged view of an exemplary metallic shell and ground electrode amid an assembly and manufacturing process, where the ground electrode has not yet been bent into place.
Figure 10:
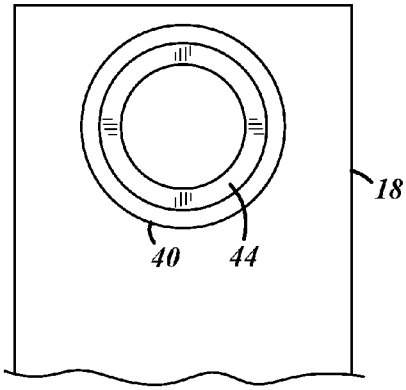

In one example in which the firing pad 40 has a square shape, such as the embodiment shown in FIGS. 3A-4, the firing pad may have a side length S at all four sides of between approximately 0.75 mm and 1.5 mm (e.g., a length of about 1.25 mm or 1.27 mm), giving a total surface area excluding the fused portion 44 at the sparking surface 42 of between approximately 0.45 $mm^2$ and 1.75 $mm^2$ (e.g., a surface area of about 1.25 $mm^2$). In another example in which the firing pad 40 has a rectangular shape, a side length of one pair of sides ranges between approximately 0.75 mm and 1.75 mm, and a side length of the other pair of sides ranges between approximately 1.0 mm and 2.0 mm (e.g., a rectangular pad with sides of 1.25 mm and 1.5 mm). These values give a total surface area at the sparking surface 42, excluding fused portion 44, that ranges between approximately 0.6 $mm^2$ and 2.8 $mm^2$ (e.g., a surface area of about 1.5 $mm^2$). In another example in which the firing pad 40 has a circular shape, such as the embodiment of FIG. 10, the circular shape may have a diameter ranging between approximately 1.0 mm and 2.0 mm, giving a total surface area excluding the fused portion 44 at the sparking surface 42 that ranges between approximately 0.60 $mm^2$ and 2.5 $mm^2$. Of course, the firing pad 40 is not limited to the above-listed dimensions, areas and ranges, as others are certainly possible.

Other geometric properties that can influence the performance and cost of the spark plug include the thickness and volume of the firing pad 40. The firing pad 40 preferably has a small thickness and volume, which reduces the overall cost of noble metal material employed, yet still provides a sufficient amount of material for improved ignitability, durability, and attachment during operation. The inventors have determined that the firing pad 40 can have an axial thickness T (FIG. 5) that is less than or equal to about 0.275 mm or, more preferably, between approximately 0.05 mm and 0.2 mm (e.g., a thickness of about 0.13 mm). In one example of the square embodiment of FIG. 4, the firing pad 40 may have a volume excluding fused portion 44 that ranges between approximately 0.025 $mm^3$ and 0.35 $mm^3$ (e.g., a volume of about 0.17 $mm^3$). In the example in which the firing pad 40 has a rectangular shape and the surface areas above, a total volume of the shape ranges between approximately 0.035 $mm^3$ and 0.65 $mm^3$ (e.g., a volume of about 0.205 $mm^3$). In the example where the firing pad 40 has a shortened cylindrical shape, such as the embodiment of FIG. 10, a total volume of the shape can range between approximately 0.035 $mm^3$ and 0.565 $mm^3$. Of course, other values and other volumes are possible, as the preceding values represent only some of the possibilities. It should be recognized that the surface area of the fused portion 44 may be different proportionately than its volume due to an irregular or non-uniform size and/or shape of the fused portion.

Furthermore, the inventors have found that certain relationships regarding the unfused surface area of the sparking surface 42 and the unfused volume of the firing pad 40 help ensure improved performance, while reducing the costs of the noble metal material. Using the unfused surface areas and volumes in the examples above, the relationship of surface area-to-volume can range between approximately 2-to-1 ($mm^{-1}$) and 20-to-1 ($mm^{-1}$) for any particular shape firing pad and, even more preferably, between about 2-to-1 ($mm^{-1}$) and 15-to-1($mm^{-1}$). The relationships above should be calculated in millimeters (mm), as other units will result in other values. Another relationship that, when satisfied, has also been found to help ensure improved ignitability and durability, and ensure an efficient and economical use of noble metal material, is unfused surface area of sparking surface 42 to axial thickness T of the firing pad 40. Using the unfused surface areas and axial thicknesses provided above, the relationship of area-to-thickness may range between approximately 4-to-1 and 50-to-1. Yet another relationship compares the values of the unfused surface area and unfused volume without regard to the units of measurement; for example, the unfused surface area may be several times or more (e.g., four times) larger than the unfused volume. The exact relationships of a given firing pad can depend upon, among other considerations, the noble metal materials that the firing pad is made out of, as well as the shape of the pad. The relationships provided above refer to the firing pad 40 after it has been attached to the center electrode or the ground electrode and, in the case of volumes, includes firing pad material that is below or embedded with the underlying electrode to which it is attached. It should be mentioned that the use of such "thin" pads, which result in some of the relationships above, is contrary to most conventional thinking in the field of spark plug precious metal tips. Most conventional spark plug precious metal tips are much thicker, as it was believed that such thicknesses were necessary for desired robustness, durability, and/or attachability. Of course, other values and other relationships are possible.

Figure 12:
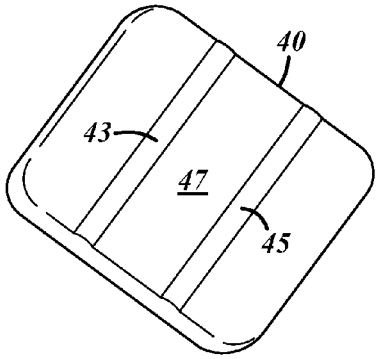
FIG. 12 is a perspective view of an exemplary flat firing pad having a pair of rails protruding from a bottom surface of the firing pad.

Whatever its geometry, the firing pad 40 is preferably made of a noble metal material and can be formed into its thin shape before attachment to the GE body 18. In specific examples, the firing pad 40 is made of a platinum (Pt) alloy like one containing between about 10% and 30% Ni and the balance being Pt, or one containing about 4% tungsten (W) and the balance being Pt (shown in weight percentages). Other materials are possible for the firing pad 40 including pure Pt, and alloys and non-alloys of iridium (Ir), ruthenium (Ru), rhodium (Rh), palladium (Pd), and rhenium (Re), to name a few. Before attachment, the firing pad 40 can be produced by way of various processes and steps including heating, melting, and metalworking. In one embodiment, the firing pad 40 is stamped, cut, or otherwise formed from a thin sheet or tape of noble metal to produce a thin pad; in another embodiment, the firing pad is cut or sliced from a thin wire of noble metal material with a diamond saw or other severing tool into individual pads, which may or may not be further flattened or metalworked to refine its shape. In the event that the firing pads 40 are formed before they are attached to the GE body 18, there is greater control over their placement on the GE body and over their thickness compared to some known tips in which the tips are formed by melting a ball of material while simultaneously pressing it to a pad-like shape by force against the GE body. The firing pad 40, on the other hand, is more readily handled when put in place on the GE body 18 resulting in comparatively less scrap, and the firing pads have a more uniform thickness over their cross-sectioned extent; some firing pads may exhibit a variance of 4% or less, or approximately 0.005 mm or less. In other embodiments, however, the firing pad 40 need not have such a uniform thickness and instead could have a non-uniform thickness over its cross-sectioned extent; for example, the firing pad 40 could have a surface opposite the sparking surface 42 that is convex, concave, stepped, or provided with rails (FIG. 12) where a thickness taken at a centerpoint of the surface is greater or less than a thickness taken at the peripheral edge P.

The firing pad 40 can be attached to the GE body 18 by a number of welding techniques, processes, steps, etc. The exact attachment process used can depend upon, among other considerations, the materials used for the firing pad 40 and for the GE body 18. In one example, and referring now to FIGS. 3B and 5, before bending the GE body 18 to an L-shape the firing pad 40 is preliminarily resistance welded or tack welded to the GE body for a non-primary or temporary hold against the GE body. In the resistance welding example, and now referring to FIG. 12, a first and second protrusion or rail 43, 45 may be provided on and project from a bottom surface 47 of the firing pad 40; and though not shown, in another example the rails may project from the working surface 26 of the GE body 18. During the resistance welding process, electrical current flow is focused and concentrated through the first and second rails 43, 45, and hence the heat generated at the rails is increased. In this way, resistance welding is facilitated at the rails 43, 45 and a stronger weld is formed between the firing pad 40 and the GE body 18. This may also inhibit or altogether eliminate separation between the firing pad 40 and the GE body 18 during use in application. In other examples, the rails need not necessarily span completely across the bottom surface 47, and there could be more or less than two rails provided. Furthermore, the firing pad 40 may be subjected to cleaning in order to remove oil, dirt, and other contaminants from the pad's outer surface; this too may facilitate welding and the formation of a stronger weld.

Then, the firing pad 40 is laser welded to the GE body 18 for a primary or more permanent hold thereagainst. A fiber laser welding type and technique can be performed for the embodiment of the figures, as well as other laser welding types and techniques. The fiber laser weld emits a more concentrated beam F that can create a defined keyhole weld which is suitable for the firing pad 40; other laser beams can also produce a suitably concentrated beam. Because the laser weld is concentrated, less material of the firing pad 40 is melted and more unfused pad material remains available for sparking. The fiber laser weld can extend entirely through the firing pad 40 itself. That is, the fiber laser welding beam F can be aimed at the sparking surface 42 with its point of entry at the sparking surface of the firing pad 40, and penetrate entirely through the axial thickness of the firing pad and into the GE body 18. Here, the materials of the firing pad 40 and the GE body 18 melt and mix together as the fiber laser welding beam F penetrates and extends through a surface-to-surface interface between the firing pad and the GE body. The fused zone or portion 44 is formed by the laser weld and is at some locations a mixture of the materials of the firing pad 40 and the GE body 18. The mixture of materials, however, may be to a lesser extent than that resulting from a laser weld that is not suitably concentrated and thereby provides more precious metal for use as a sparking surface. In other embodiments, the firing pad 40 could be attached to the GE body 18 solely by a resistance weld and need not include a laser weld.

In the example of FIG. 3B, the fused portion 44 is a single continuous weld or molten bond that is located entirely inboard or radially inward of the peripheral edge P, and that generally follows the shape of the peripheral edge P, in this case a square. In other embodiments not shown in the figures, the fused portion is not wholly inboard of the peripheral edge P and could be made up of separate and distinct individual fused portions (i.e., non-continuous welds). For example, the fused portion 44 could begin and/or end outboard of the peripheral edge P, and could be separate and distinct lines that span entirely across the firing pad 40 and criss-cross one another; in one specific example, the fused portion could include four separate and distinct lines, two arranged parallel to each other and the other two parallel to each other but transverse to the first two, each spanning entirely across the firing pad similar to a tic-tac-toe board; and in another specific example, a single individual fused portion could be located at the center of the sparking surface and could serve to supplement another fused portion such as the fused portion 44 shown in the figures. In the embodiment of FIG. 3B, because of its inboard location and continuity, a first or inner unfused portion 46 is defined within the radially-inward confines of the fused portion 44, and a second or outer unfused portion 48 is defined radially-outward of the fused portion and spans to the peripheral edge P. Furthermore, the fused portion 44 provides an improved retention of the firing pad 40 and an improved consistency among welds of manufactured spark plugs, compared to some known laser welds that are directed at the interface of the firing tip and an electrode body which produces a weld pool at the peripheral edge. In the context of the previous discussion, the unfused surface area in FIG. 3B would constitute the sum of unfused portions 46 and 48.

During its welding attachment, the firing pad 40 can be physically embedded and displaced into the GE body 18—this is sometimes referred to as the upset U (denoted in FIG. 5 by broken lines). Due to the attachment process, the firing pad 40 can sink into the GE body 18 below the working surface 26 such that the firing pad has a reduced axial projection toward the CE body 12 measured from the working surface 26 to the sparking surface 42. In one example, the firing pad 40 sinks into the GE body 18 by an embedded or upset distance that is no more than approximately 20% of the overall axial thickness T of the firing pad, meaning that more than approximately 80% of the axial thickness T remains projecting beyond the working surface 26 toward the CE body 12; other examples with other upset distances and percentages are possible. As previously described, the axial thickness T of the firing pad 40 can range between approximately 0.05 mm and 0.2 mm (e.g., approximately 0.13 mm) and after attachment the firing pad sinks into the GE body 18 by an upset distance of between 0.01 mm and 0.04, respectively, (e.g., about 0.024 mm). Other examples with other values and relationships are possible.

In the embodiment of FIG. 2, when attached to the GE body 18 and after bending the GE body over the CE body 12, the firing pad 40 has a center axis that is preferably aligned and coincident with the center axis A of the spark plug 10 and that is preferably aligned and coincident with the center axis of the CE firing tip 28; this, of course, is just one example of a firing end configuration, and in other configurations the axes need not be aligned and indeed could be offset, transverse, or otherwise cross each other. In the embodiment shown here, the axially-facing sparking surface 42 of the firing pad 40 directly confronts and can exchange sparks with the sparking surface 36 of the CE firing tip 28 axially across the spark gap G (in other embodiments, firing pad 40 exchanges sparks with the distal end surface of the CE body 12). The sparking surface 42 has a surface area that is greater than a surface area of the sparking surface 36, and therefore an imaginary axial projection of the sparking surface 36 onto the sparking surface 42 can be cast within the peripheral edge P of the sparking surface 42. This arrangement may facilitate a bending, alignment, and gapping process of the GE body 18 in which the GE body is bent from vertically straight (FIG. 3A) to L-shape (FIG. 1), while the center axes of the CE firing tip 28 and firing pad 40 are aligned. Because of manufacturing tolerances and general imperfections, the center axes are sometimes slightly misaligned which can adversely affect sparking performance of tips with sparking surface areas that are the same or close in value. Manufacturing tolerances for the firing ends described herein, in contrast, have little or no affect on sparking performance because, even when the center axes of the CE firing tip 28 and firing pad 40 are somewhat misaligned, the sparking surface 36 can still be cast within the peripheral edge P of the sparking surface 42 so that sparks can be suitably exchanged therebetween.

The firing pad 40 can have different shapes and can be arranged on the GE body 18 in different ways, while still possessing the geometric properties and satisfying the relationships described above. In the embodiment of FIG. 3B, the firing pad 40 has a generally square/cube shape and is arranged in an angular offset or diamond orientation (e.g., 45°) with respect to the lengthwise extent of the GE body 18. This angular offset orientation further facilitates the bending, alignment, and gapping process of the GE body 18 because a diagonal of the square shape (i.e., its greatest sparking surface length) is generally in-line with the direction of bending, thereby allowing the sparking surface 36 of the CE firing tip 28 to be readily cast within the peripheral edge P of the sparking surface 42.

Figure 6:
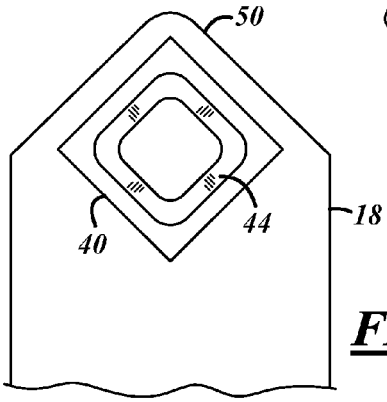
FIGS. 6-11 are enlarged views of other potential embodiments of flat firing pads attached to ground electrodes.
Figure 7:
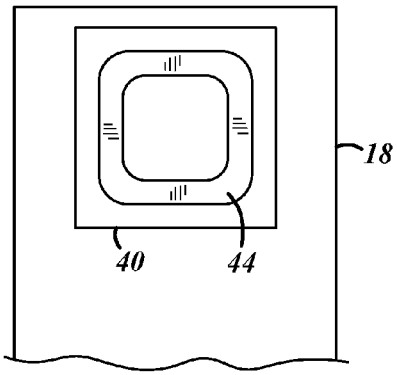
Figure 8:
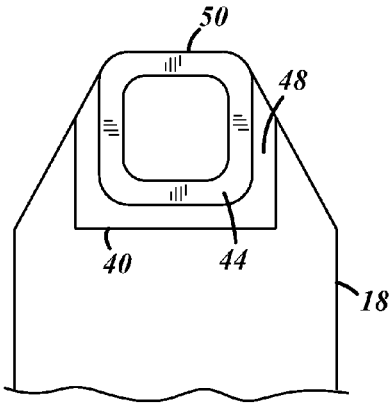
Figure 9:
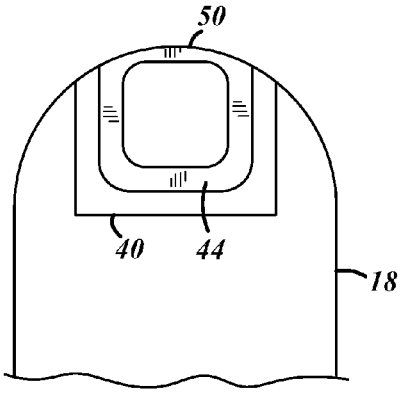
Figure 11:
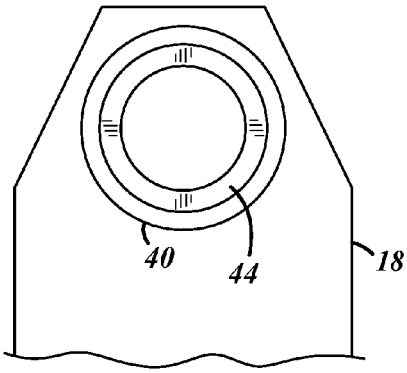

In the embodiment of FIG. 6, the firing pad 40 still has a diamond orientation but the end portion of the GE body 18 is trimmed or narrowed on its sides to form what is sometimes referred to as a V-trim. The sides can be trimmed, cut, or otherwise metalworked so that the GE body 18 tapers in radial width toward a radially-facing free end surface 50 and to a somewhat blunted nose. In FIG. 7, the firing pad 40 has a square orientation, and in FIG. 8 the GE body 18 is again V-trimmed. In this case, however, the V-trim is truncated and ends at a planar surface instead of a blunted nose. The planar surface at the radially-facing free end surface 50 can be formed via trimming, cutting, or other metalworking ways. The trimming can take place once the firing pad 40 is attached to the GE body and can even result in configurations where the edge of the firing pad is flush with the edge of the GE body. The inboard weld that is spaced inwardly from the peripheral edge P allows for a tighter trimming of the GE body 18 because the trimming tools do not need to cut through a hardened weld pool. A GE body 18 that has been trimmed, as in FIGS. 6, 8, and 9, results in less electrode material at or near the spark gap G; this can have a positive influence on performance in terms of thermal management and/or flame kernel growth. Indeed, in the embodiment of FIG. 8, the outer unfused portion 48 can be trimmed concurrently with the GE body 18. In the embodiment of FIG. 9, the end portion of the GE body 18 is trimmed to have a rounded free end surface 50. And in the embodiments of FIGS. 10 and 11, the firing pad 40 has a generally circular/cylindrical shape, and the GE body 18 of FIG. 11 has a V-trim while that of FIG. 10 does not. Still, other shapes and orientations are possible including a rectangle, oval, or irregular shape. Depending on the embodiment, the trimming can take place before or after the firing pad 40 is attached to the GE body 18.

In other embodiments not shown in the figures, the firing pad 40 could be provided as part of the spark plug 10 and firing end in different ways. For example, the firing pad 40 could be welded directly or indirectly (e.g., via an intermediate piece) to the CE body 12 and not welded to the GE body 18, or it could be welded directly or indirectly to a distal end surface of the GE body, or it could be welded directly or indirectly to both the GE body and the CE body, to cite a few possibilities.

Some thermal testing was performed in order to observe retention performance between the firing pad 40 and GE body 18. In the testing, the firing pad 40 and GE body 18 were attached to each other via one embodiment of the fused portion 44 in which four separate and distinct weldment lines were provided in a criss-cross or tic-tac-toe arrangement with a first pair arranged parallel to each other and a second pair arranged parallel to each other but transverse to the first pair. In this embodiment, each weldment line spanned completely across the firing pad. In general, the thermal testing subjected the firing pad 40, GE body 18, and fused portion 44 to an increased temperature for a relatively abbreviated period of time, and then allowed them to cool to ambient temperature. The testing was meant to simulate expansion and contraction thermal stresses that are more extreme than those experienced in application in a typical internal combustion engine.

In the example testing conducted, a sample spark plug was mounted in a collar-like structure made of brass material. The collar structure was secured to the shell of the sample spark plug and did not make direct abutment with the GE body; the mount structure acted as a heat sink and facilitated cooling. An induction heater was then used to heat the attached firing pad 40 and GE body 18 up to 1,700° F. for about 20 seconds. After that, the firing pad 40 and GE body 18 were allowed to cool at rest down to about room temperature or slightly above room temperature. This rise and fall in temperature constituted a single test cycle, and the thermal testing was conducted on numerous sample spark plugs. On average, the sample spark plugs were capable of enduring over one-hundred-and-seventy-five cycles without exhibiting significant cracking, separation, or other conditions that could negatively impact retention between the firing pad 40 and the GE body 18. One-hundred-and-seventy-five cycles is considerably greater than the one-hundred-and-twenty-five cycles deemed acceptable according to certain testing guidelines, and was unexpected in view of how thin the firing pads were. The cycles endured in the testing here is also comparable to pads with much greater thicknesses than the thin firing pads tested; this too was unexpected.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A spark plug, comprising:

a metallic shell having an axial bore;

an insulator having an axial bore and disposed at least partially within the axial bore of the metallic shell;

a center electrode disposed at least partially within the axial bore of the insulator;

a ground electrode attached to the metallic shell; and a thin firing pad attached to the center electrode, the ground electrode, or both, wherein the thin firing pad is made from a noble metal and includes an unfused sparking surface area ($mm^2$) and an unfused volume ($mm^3$), wherein the number associated with the value of the unfused sparking surface is at least two times larger than the number associated with the value of the unfused volume.

2. A spark plug as defined in claim 1, wherein the thin firing pad includes at least one noble metal selected from the group consisting of: platinum (Pt), iridium (Ir), or ruthenium (Ru).

3. A spark plug as defined in claim 1, wherein the thin firing pad is an ultra thin firing pad with a greatest sparking surface dimension (L) that is at least four times larger than its greatest thickness dimension (T).

4. A spark plug as defined in claim 3, wherein the ultra thin firing pad has a thickness dimension (T) that is less than or equal to approximately 0.275mm.

5. A spark plug as defined in claim 3, wherein the ultra thin firing pad has a relationship of unfused sparking surface area to unfused volume that is between approximately 2-to-1 ($mm^{-1}$) and 20-to-1 ($mm^{-1}$), inclusive.

6. A spark plug as defined in claim 1, wherein the thin firing pad has a fused portion located mostly inboard of a peripheral edge of a sparking surface, the fused portion defining a first unfused sparking surface area located inward of the fused portion and a second unfused sparking surface area located outward of the fused portion.

7. A spark plug as defined in claim 6, wherein the fused portion generally follows the peripheral edge of the sparking surface and is located near the peripheral edge of the sparking surface so that the first unfused sparking surface area is greater than the second unfused sparking surface area.

8. A spark plug as defined in claim 6, wherein the peripheral edge of the sparking surface and the fused portion are generally defined by at least one shape selected from the group consisting of: a square, a rectangle, or a circle.

9. A spark plug as defined in claim 1, wherein a free end surface of the ground electrode is trimmed so that it is flush with a peripheral edge of a sparking surface of the thin firing pad for a section of the peripheral edge.

10. A spark plug as defined in claim 9, wherein the thin firing pad has a fused portion located mostly inboard of the peripheral edge of the sparking surface, the free end surface of the ground electrode is trimmed so that the free end surface is flush with the peripheral edge of the sparking surface and the fused portion for a first portion of the peripheral edge and the free end surface of the ground electrode is not flush with the peripheral edge of the sparking surface and the fused portion for a second portion of the peripheral edge.

11. A spark plug as defined in claim 1, wherein the thin firing pad is embedded into the electrode(s) after welding by an embedded distance (u), and the thin firing pad has a relationship of thickness dimension (T) to embedded distance (u) that is between approximately 2-to-1 and 15-to-1, inclusive.

12. A spark plug as defined in claim 1, wherein, before attachment to the electrode(s), the thin firing pad has a thickness variance of less than or equal to approximately 0.005mm across its extent.

13. A spark plug as defined in claim 1, wherein the thin firing pad has a fused portion that is produced by a laser welding beam with a point of entry at a sparking surface and penetrating from the sparking surface all the way through the thin firing pad.

14. A spark plug as defined in claim 13, wherein the fused portion is a keyhole weld that is produced by a concentrated fiber laser welding beam.

15. A spark plug as defined in claim 1, wherein the unfused sparking surface area ranges between approximately $0.45mm^2$ and $2.8mm^2$, inclusive.

16. A spark plug as defined in claim 1, wherein the unfused volume ranges between approximately $0.025mm^3$ and $0.65mm^3$, inclusive.

17. A spark plug as defined in claim 1, wherein the thin firing pad has a relationship of unfused sparking surface area to thickness dimension (T) that is between approximately 4-to-1 (mm) and 50-to-1 (mm), inclusive.

18. A spark plug as defined in claim 1, wherein, before attachment to the electrode(s), the thin firing pad has at least one protrusion projecting from a bottom surface of the thin firing pad, the at least one protrusion concentrating current flow therethrough during a resistance welding process.

19. A spark plug, comprising:

a metallic shell having an axial bore;

an insulator having an axial bore and disposed at least partially within the axial bore of the metallic shell;

a center electrode disposed at least partially within the axial bore of the insulator;

a ground electrode attached to the metallic shell; and an ultra thin firing pad attached to the center electrode, the ground electrode, or both, wherein the ultra thin firing pad is made from a noble metal and is attached with a fused portion that extends from a sparking surface all the way through the ultra thin firing pad, the fused portion is located mostly inboard of a peripheral edge of the sparking surface and follows the peripheral edge for at least a portion of the peripheral edge.

20. A spark plug as defined in claim 19, wherein the ultra thin firing pad has a thickness dimension (T) that is less than or equal to approximately 0.275mm.

21. A spark plug as defined in claim 19, wherein an unfused sparking surface area ranges between approximately $0.45mm^2$ and $2.8mm^2$, inclusive.

22. A spark plug as defined in claim 19, wherein an unfused volume ranges between approximately $0.025mm^3$ and $0.65mm^3$, inclusive.

23. A spark plug as defined in claim 19, wherein the fused portion is located mostly inboard of the peripheral edge of the sparking surface, the fused portion defining a first unfused sparking surface area located inward of the fused portion and a second unfused sparking surface area located outward of the fused portion.

24. A spark plug as defined in claim 19, wherein the ultra thin firing pad has a keyhole weld that is produced by a concentrated fiber laser welding beam.

25. A spark plug firing pad, comprising:

a noble metal material;

a greatest dimension across a sparking surface that is at least several times larger than a greatest thickness dimension taken generally orthogonal to the sparking surface, wherein the greatest thickness dimension is less than or equal to approximately 0.275mm;

a sparking surface area ranging between approximately $0.56mm^2$ and $3.5mm^2$; and a fused portion located mostly inboard of a peripheral edge of the sparking surface, the fused portion defining a first unfused sparking surface area located inward of the fused portion and a second unfused sparking surface area located outward of the fused portion.

26. A spark plug firing pad as defined in claim 25, further comprising a thickness variance of less than or equal to approximately 0.005mm across its extent.

* * * * *